United States Patent [19]

Schönthaler et al.

[11] 4,372,488

[45] * Feb. 8, 1983

[54] LEVEL CROSSING FOR RAILROADS AND METHOD OF FABRICATING THE SAME

[75] Inventors: Karl Schönthaler, Bad Ischl; Gerhard Hartl, Vienna, both of Austria

[73] Assignee: Semperit Aktiengesellschaft, Vienna, Austria

[ * ] Notice: The portion of the term of this patent subsequent to Feb. 8, 1999, has been disclaimed.

[21] Appl. No.: 560,500

[22] Filed: Mar. 20, 1975

[30] Foreign Application Priority Data

Mar. 20, 1974 [CH] Switzerland ..... 3887/74

[51] Int. Cl.[3] ..... E01C 9/04

[52] U.S. Cl. ..... 238/8

[58] Field of Search ..... 238/1, 2, 3, 4, 5, 6, 238/7, 8, 9; 308/3 R

[56] References Cited

U.S. PATENT DOCUMENTS

| | | | |
|---|---|---|---|
| 1,493,406 | 5/1924 | Van Doren et al. | 238/8 |
| 2,067,037 | 1/1937 | Alexander | 238/8 |
| 2,076,338 | 4/1937 | Greely | 238/8 |
| 2,984,417 | 5/1961 | Voorhees | 238/8 |
| 3,349,418 | 10/1967 | Hein | 308/3 R X |
| 3,484,882 | 12/1969 | Blanchette | 308/3 R |
| 3,643,864 | 2/1972 | Ziegler | 238/8 |
| 3,825,184 | 7/1974 | Hartl | 238/8 |
| 3,861,591 | 1/1975 | Rector | 238/8 |
| 3,863,840 | 2/1975 | Szarka et al. | 238/8 |
| 3,938,852 | 2/1976 | Hein et al. | 308/3 R |

*Primary Examiner*—Randolph A. Reese

*Attorney, Agent, or Firm*—Werner W. Kleeman

[57] ABSTRACT

A level crossing for a railroad and a method of fabricating the same comprising outer plates arranged between the rails and the body of the roadway, the outer plates being supported at one side at the rails and at the other side at a profiled constructed closure provided for the roadway body. The positive supporting of the outer plates at the profiled constructed closure is achieved through the agency of elastic molded bodies formed of rubber, plastic or the like.

10 Claims, 9 Drawing Figures

LEVEL CROSSING FOR RAILROADS AND METHOD OF FABRICATING THE SAME

BACKGROUND OF THE INVENTION

The present invention relates to a new and improved construction of a level crossing for railroads of the type incorporating inner plates arranged between the rails and forming a part of the path of travel or track, and outer plates arranged between the rails and the road body, said outer plates being supported at one side at the rails and at the other side at a profiled or shaped closure of the road body. The invention further pertains to a novel method of fabricating the aforesaid level crossing.

Level crossings for railroads of the previously mentioned type are already known to the art. According to a known construction of the prior art the supporting of the outer plates, consisting of iron, is achieved through the agency of profile elements arranged at the road body, the profile elements being formed of metal, and whereby the outer plates tightly bear upon the metallic profile elements. When street or road vehicles, such as cars, trucks and so forth, continually pass over the railroad crossing, with these prior art constructions there occur vibrational oscillations which have very disadvantageous affects. An additional problem arises when the outer plates are not formed of iron, rather of concrete. Concrete plates are very sensitive to oscillations and due to vibrational effects it is easily possible for there to be formed fissures or cracks in the outer edges of the outer plates. Once such fissures are present then there exists the danger, especially in the pressence of large forces exerted by heavy vehicles rolling over the level crossing, that the plates will rupture, leading to disturbance in the roadway traffic.

SUMMARY OF THE INVENTION

Hence, it is a primary object of the present invention to provide an improved construction of a level crossing for railroads which is not associated with the aforementioned drawbacks and limitations of the prior art proposals.

Another and more specific object of the invention aims at the provision of a novel level crossing wherein it is possible to absorb at the side of the road or street the vibrational oscillations caused by the continuous passage of vehicles or the like over the level crossing of the railroad, and wherein the advantages realized by mounting the closure of the outer plate at the side of the roadway in a profile or shaped element arranged at the road body does not in any way minimize the possibility of rapid and simple assembly and disassembly of the level crossing.

Still a further object of the present invention relates to a new and improved method of fabricating the level crossing of this development.

Now in order to implement these and still further objects of the invention, which will become more readily apparent as the description proceeds, the invention contemplates that the positive supporting of the outer plates at the profiled or shaped-constructed closure of the road body occurs through the agency of elastic molded bodies formed of rubber, plastic or the like.

There is thus achieved between the outer plate and the profile of the roadway edge a positive connection which is capable of taking-up the surge loads caused by the roadway vehicles rolling over the crossing, and further, preventing the formation of cracks owing to the relatively hard resistance of the outer plate in comparison to the elastic roadway covering.

It is particularly advantageous if the closure of the roadway or road body is shaped or profiled in a groove-like manner. In this way there is produced a particularly permanent connection of the outer plate with the roadway body, which outer plate is configured in a resilient or spring-like manner at the edge. In this way there is realized, particularly for the outer plates which for the most part are fabricated as prefabricates structures of concrete, an especially favorable transmission of the forces caused by the road traffic to the groove-like constructed profile or shaped element, without there being damaged the concrete which is sensitive to surge-like loads.

It is advantageous particularly for railroad crossings over which travel lighter road vehicles, for instance at secondary roads, if the groove-like profiling or shaping is formed at an essentially vertical surface of the roadway body closure since, on the one hand, due to the inventive arrangement of the groove-like profiling there is realized a rapid and simple mounting or assembly possibility with a most simple construction and, on the other hand, the pressures caused by lighter vehicles can be takenup without overloading the spring-like constructed closure of the outer plate.

The advantage of a further constructional possibility of the invention in terms of the construction of the groove-like profiling or profiled portion at an essentially horizontal surface resides in the fact that the forces acting perpendicular to the groove-like profiling can be favorably transmitted from the outer plate to the roadway body, and the aforementioned advantages of an impact or surge dampening by an elastic molded body and the possibility of rapid mounting remain intact. This constructional embodiment of the invention is particularly suitable for use with railroad crossings at main or primary roads which are often traveled over by heavy vehicles.

Equally it can be advantageous if the closure of the roadway body is profiled or shaped in a spring-like manner. This constructional manifestation likewise permits of an equally easily releasable connection of the outer plate with the roadway body, and which connection is capable of absorbing the heavy loads of the roadway traffic, especially if steel is used, since the groove-like construction of the outer plate closure owing to the spring-like construction of the roadway body then insures for a particularly good possibility of transmitting the forces.

A further improvement can be realized when the shaped or profiled closure of the roadway body is releasably connected with the remaining roadway body. In this way there is insured a rapid replacement of the shaped or profile element when such is necessary due to a change in the configuration or formation of the edge of the outer plate. In this way it is thus possible to very easily adapt already existing railroad crossings for use with the inventive construction.

It is particularly advantageous if the profiled closure or closure member of the roadway body is constituted by a profile or shaped element formed of metal, concrete, plastic or the like, whereby there can be obtained in a simple manner a groove-like profiling for the reception of the outer plates at an essentially vertical surface of the roadway body. In particular metallic profile or shaped members, for instance railroad tracks or rails have been found to be especially suitable for the reception and mounting of the outer plates. At the railroad crossings where the outer plates themselves are supported at the side of the rails, there is thereby realized a particularly favorable load distribution and thus increased longevity of the railroad crossing.

Furthermore, it has been found to be advantageous if the profiled closure of the roadway body bears upon a molded concrete component. It has been indeed found, especially at railroad crossings, wherein the attachment of the outer plates at the side of the roadway bears in the outer gravel bed that owing to the traffic loads forces are transmitted to the gravel bed which could lead to damage at the upper structure of the tracks. Due to the supporting of the profiled or shaped roadway closure which carries one side of the outer plate upon a concrete molded body as contemplated by the invention, and which concrete molded body is completely separated from the gravel bed and the track body, the traffic loads are no longer directly transmitted to the crossties or the gravel bed, rather are propogated into the rails. In this way there is obtained a uniform loading of the rail or track body.

It is especially advantageous, in the case where there is used metallic profiles or structural shapes as the profile or shaped elements if the attachment devices for the profile element at the molded concrete component is applied at a spacing which amounts to an integral multiple of the outer plate width. The supported portions of the outer plates thus can be constructed to be continuous, without exhibiting recesses for the attachment devices. Fabrication of the outer plates is therefore appreciably simplified.

Improved measures, particularly with respect to obtaining as uniform distribution as possible of the forces brought about by the roadway traffic at the supports or bearings of the outer plates, can be attained if there is arranged between the molded concrete component and the profiled or shaped closure of the roadway body an intermediate layer formed of an elastic material, for instance rubber, plastic or the like. In this way it is possible, on the one hand, to avoid the formation of fissures or cracks in the support edge of the outer plate owing to the dampening characteristics of the intermediate layer, and on the other hand, by suitably dimensioning the intermediate layer it is possible to compensate or correct elevational differences between the roadway body and the track body in a very simple manner.

A considerable problem concerning the longevity of a level crossing of a railroad resides in the fact that after the same has been employed for a long period of time there can arise a dropping of the outer plate at the closure at the side of the roadway due to changes in the gravel bed and also in the under structure of the roadway. This elevational difference, on the one hand, reduces the traveling comfort for the roadway vehicles passing over the level crossing and, on the other hand, the edge of the roadway covering becomes damaged owing to the surge load occurring there. A further drawback which can arise in consequence thereof is that there can form a gas between the closure of the roadway body and the outer plate.

In order to counteract this drawback of gap formation between roadway closure and the outer plate which is supported thereon, the invention contemplates arranging the outer plate at the profiled or shaped closure of the roadway body in such a way that the vertical spacing of the upper edge of the profile element closing the roadway body and the outer plates supported thereon is adjustable.

Also the reduction of the restoring forces of the elastic molded body arranged between the profile element and the outer plate and brought about by fatigue after long use of the level crossing owing the continuous loading by the traffic rolling over the level crossing can be compensated in this manner at any time by raising the plate at the street level. However, also any other causing bringing about an elevational difference between the roadway closure and the outer plate, for instance due to a rapid wear of the roadway covering, can be counteracted in this way without difficulty and without the need to carry out any special expenditure in work.

The outer plates advantageously can possess at the region of the profile element, for the purpose of changing the position thereof, preferably self-locking adjustment screws. Such render possible an infinite accommodation of the outer plate to the level of the roadway body or roadway, and owing to the self-locking action of the threading there is not required any type of arresting device. The self-locking of the screw can be further assured in that a groove-like recess which extends along the screw is filled with plastic, preferably polyethylene. A further advantage can be attained if the adjustment or adjusting screw is adjustable from the outside with the aid of an appropriate key or wrench or equivalent structure, and in this way there can be realized an accommodation of the outer plate to the level of the roadway body without the need to resort to time-consuming dismantling operations which require a great deal of work.

Of course, it is within the framework of the invention to effectuate the adjustment of the spacing of the outer plate to the profiled or shaped closure of the roadway body also by means of a different known expedient, for instance by arranging two wedges on top of one another which collectively form a parallelepiped which is held together by screws in a slot-shaped bore. By moving the wedges relative to one another it is thus possible to likewise adjust the elevation.

There can be advantageously arranged metallic plates between the adjustment screws and the elastic molded bodies formed of rubber, plastic or the like and which bear at the profile element, so that the high pressures acting upon the adjustment screws by virtue of the traffic traveling over the railroad crossing are transmitted to a larger surface, with a result that the pressures acting upon the profile element are smaller.

In order to prevent a displacement—especially by virtue of a surge-like loading—it is advantageous if the metallic plate and molded body are located in a recess formed at the profile element. However, the rubber plate can also advantageously be cast, at least in part, in the profile element during the fabrication thereof.

A simple and especially permanent connection between metallic plate and molded element can be achieved if the metallic plate is vulcanized to the molded body formed of rubber.

According to the invention the end of the outer plate at the side of the road can contact the profile or shaped element, so that there is obtained a gapless, uniform transition of the profile element closing-off the roadway body to the outer plate. Furthermore, the intimate contact with the profile element prevents impacting of the outer plate at the profile element owing to the thrust forces caused by the roadway traffic. In order to especially increase the uniformity of the transition between the road and the outer plate and to prevent the formation of a crack by the profile element, it is advantageous if the profile element at the region of the transition to the outer plate is covered with the roadway covering. A crack formation due to the sudden transition of the elastic roadway covering to the hard profile element would still considerably increase the surge-like loading of the outer plate at the region of the profile body.

The surge-like loading of the outer plate by the abrupt transition of the roadway body to the outer plate can be advantageously also reduced by providing a beveling of the end of the outer plate at the side of the roadway. The outer plate is pressed against the elastic molded element arranged at the side of the rails due to the beveling at the end at the side of the roadway and the intimate contact with the profile element as a function of the pressure exerted upon the adjustment screws, so that there is suppressed a surge-like movement in horizontal direction caused by the thrust forces arising in the direction of travel of the roadway vehicles.

According to a further constructional manifestation of the invention there can be arranged an elastic band, for instance formed of expanded or cellular rubber, soft or non-rigid foamed polyurethane or the like between the vertical walls of the groove and the molded body which is preferably connected with the metallic plate.

For reasons of simplifying the assembly the metallic plate and the molded body, during the fabrication of the profile element, are inserted into the groove-like recess, whereby there is impaired the vertical compressibility of the elastic molded body. The laterally applied band-shaped strips formed of cellular or expanded rubber or the like thus render possible maintaining the resilient or spring characteristics of the molded body.

A particularly advantageous method for fabricating the inventive level crossing for railroads resides in the features that the profile body serving as the profiled closure of the roadway body or roadway, and which profiled body is formed of metal, concrete, plastic or the like, is placed upon a concrete foundation fabricated at the region of the roadway body closure, the outer plate is arranged between the rail and profile element, partially bearing thereon, and is pressed with the profile element at the molded element applied at the rail, whereafter the position of the profile element is fixed by embedding in gravel and thereafter the outer plate is compensated to the level of the street by rotating the adjustment screws.

Then the profile elements are first placed upon the concrete foundation arranged at the spacing of the length of the outer plates from the rail or track. This can advantageously occur by means of lifting tongs bearing upon the rails or tracks. Thereafter the outer plate—bearing at the profile element at the side of the roadway—is retained at the rail-side closure by lifting tongs or clamps at the elevation of the groove-like recesses formed by the molded elements. By means of a double-arm lever, wherein one arm bears against the surface of the profile element confronting the roadway body, it is possible to press in a simple manner the outer plate by means of the profile body into the recesses of the molded element, in order to thereby obtain a positive connection with the rails. The forces acting by means of the lever arms upon the profile element are thus uniformly transmitted over the entire cross-section of the outer plate, so that at the side of the rails there can be produced over the entire width of the outer plate a uniform positive connection. The outer plate bearing at the side of the roadway at the profile element can now be adjusted to the level of the roadway surface by rotating the adjustment screw. Now in order to prevent a displacement of the profile or shaped element out of its position it is subsequently surrounded by gravel or the like which is advantageously compacted.

By virtue of this method there is obtained especially the advantage, in contrast to every other possible assembly or mounting possibility, that the force required for displacement of the profile element and the outer plates and acting upon the profile element is uniformly transmitted over the entire cross-sectional surface. Furthermore, by virtue of the massive or heavy profile element there is obtained a considerably more favorable attack surface for the lever arms.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
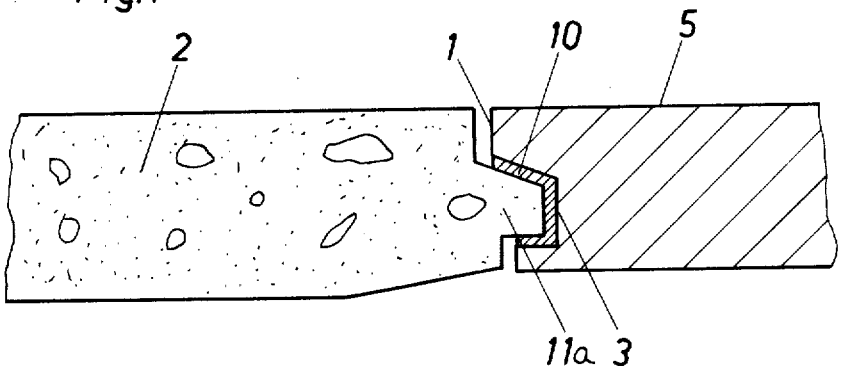
FIG. 1 is a sectional view of a first embodiment of attachment of the outer plate at the profiled or shaped edge or edge region of the roadway.

Describing now the drawings, as illustrated with the exemplary embodiment of FIG. 1 a projection 11*a* of the outer plate 2 fits into a groove-like or channel-like recess 3 of a profiled or shaped edge 1 of the roadway body 5 and provides a positive connection through the agency of the elastic molded body 10.

Figure 2:
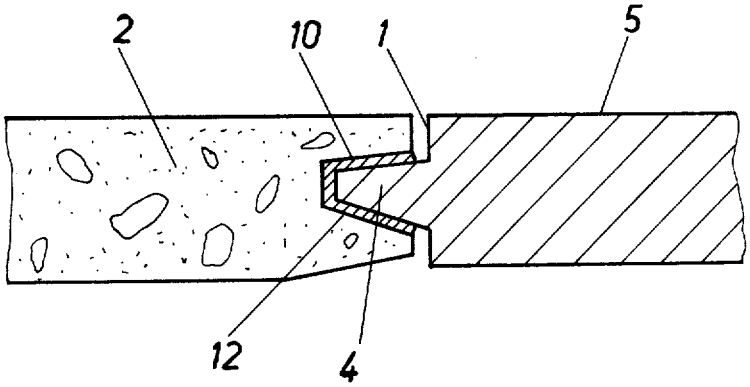
FIG. 2 is a sectional view of a second embodiment of inventive attachment of the outer plate at the profiled or shaped edge or edge region of the roadway.

A different connection arrangement as contemplated by the invention between the roadway body 5 and the outer plate or plate member 2 has been illustrated in FIG. 2. The resilient or spring-like profiled or shaped portion 4 of the roadway body edge 1 fits into a groove-like recess 12 of the outer plate 2 which is lined with an elastic molded body 10.

Figure 3:
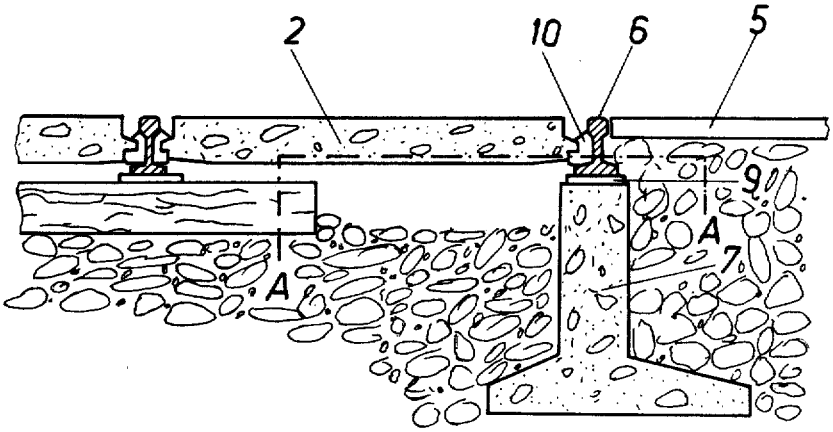
FIG. 3 illustrates in sectional view a level crossing for a railroad as contemplated by the invention.

In order to render possible an appropriate accommodation of the profiled or shaped roadway closure as quickly as possible upon changes of the profiled configurations of the outer plates, it is contemplated by the invention, as best seen by referring to FIG. 3, that the profile or shaped body 6, serving to receive, via elastic molded element 10, the outer plate 2, is constructed separately from the remaining roadway body 5. The profile or shaped element 6, preferably a metallic rail or track, bears upon a molded or cast concrete component 7. In order to be able to take-up and compensate surge loads of the roadway traffic and elevational differences between the railroad crossing and the roadway body an elastic intermediate layer 9 is located between the profile element 6 and the concrete body or component 7, profile element 6 here defining the roadway closure.

Figure 4:
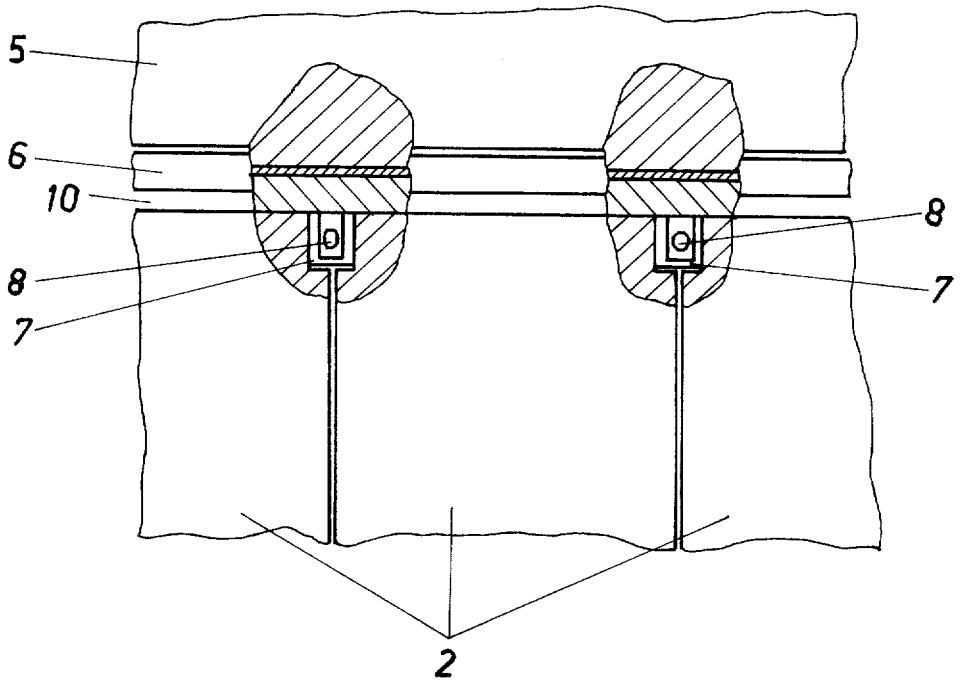
FIG. 4 is a sectional view of the inventive railroad level crossing along a plane parallel to the surface of the outer plate at the elevation of the line A—A of FIG. 3.

As shown in FIG. 4 the spacing of the attachment devices 8 for the profile element 6 at the molded concrete body correspond to the width of an outer plate or an integral multiple thereof respectively. In this way the support cradles or claws of the plates can be constructed to be continuous; only at the underside of the plates is there located at the corners recesses for the attachment elements. In this way there is considerably simplified the fabrication of the plates.

Figure 5:
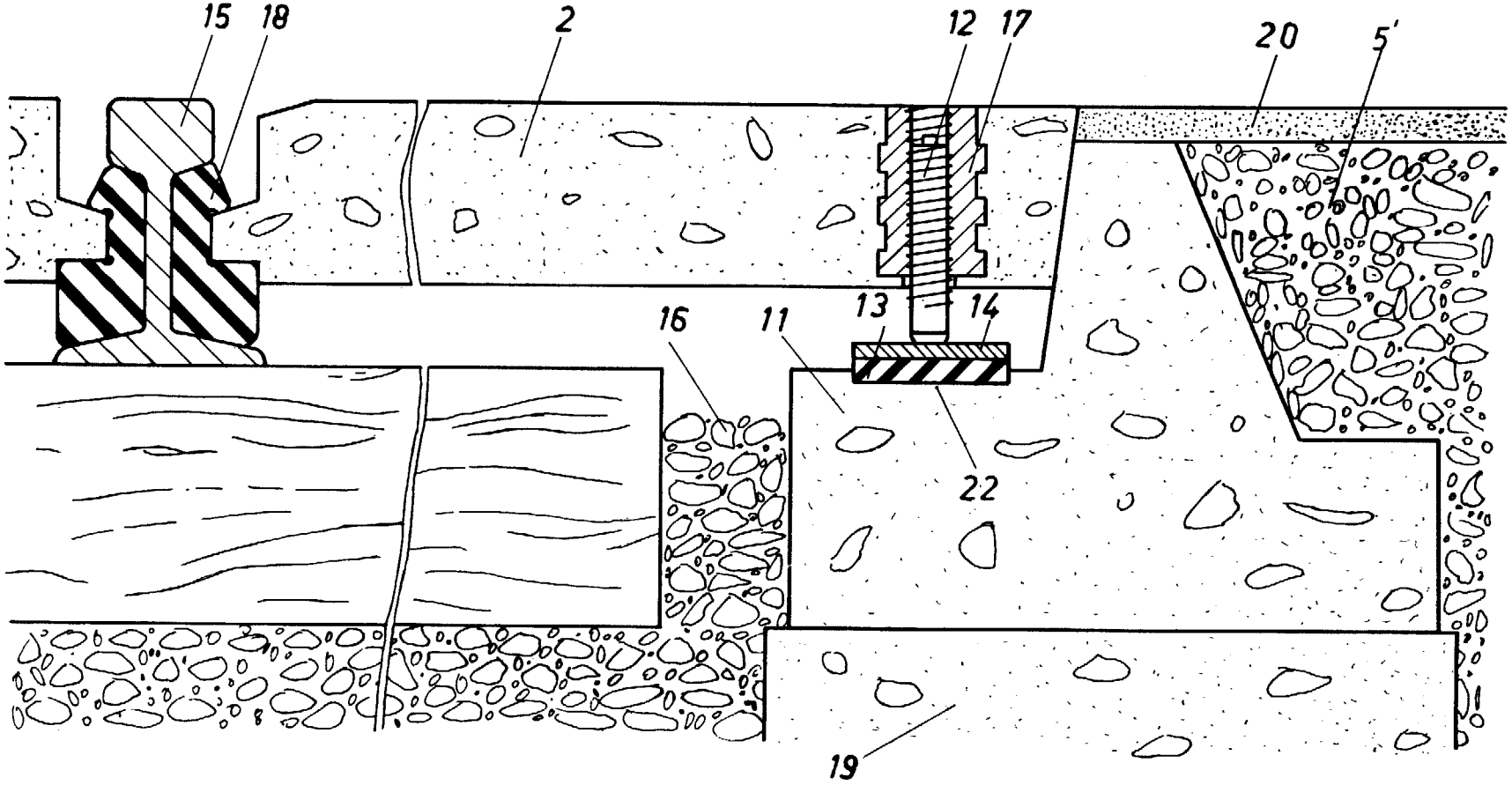
FIG. 5 is a cross-sectional view through a further exemplary embodiment of railroad level crossing as contemplated by the invention.

FIG. 5 is a cross-sectional view looking in the direction of travel of the roadway traffic. The outer plate 2 which is arranged between the rail or track 15 and the roadway body 5' bounded by the profile or shaped body 11, and which outer plate 2 extends freely over the gravel bed 16 or the like, is supported at the side of the rail or track in a known manner by an elastic molded element 18 which is formed of rubber, plastic or the like. Furthermore, according to the invention the mounting of such outer plate 2 at the side of the roadway or street occurs through the agency of an adjustment or regulating screw 12 which bears upon the profile or shaped body 11 and which is rotatable in a threaded nut member 17 which is cast in the outer plate 2. Between the adjustment or adjusting screw 12 and the profile body 11 there are arranged a metallic plate 14 and a molded element 13. The plate 14 distributes the pressure caused by the roadway traffic at the adjustment screw over a larger surface, so that the loading is less for the profile body 11 which is preferably cast from concrete and manufactured as a finished or prefabricated component. The molded element 13 serves for taking-up the vibrational oscillations and can be advantageously cast in part in the profile element 11. According to another exemplary embodiment of the invention the molded piece or element 13 which is connected for instance by vulcanization with the metallic plate 14 can also be located in a recess arranged at the profile or shaped body 11 defining the profiled closure of the roadway body 5'.

The profile body 11 advantageously bears upon a concrete foundation 19 so that there is imparted thereto a greater stability and such can be erected in a simpler manner. In order to prevent the formation of a crack or the like at the region of the transition to the outer plate 2 owing to the hard resistance of the profile body 11 this profile body 11 is covered by an elastic roadway coating or covering 20 which, similar to a portion of the profile body 11, contacts the beveled impact surface of the outer plate 2 as clearly shown by referring to FIG. 5.

Figure 6:
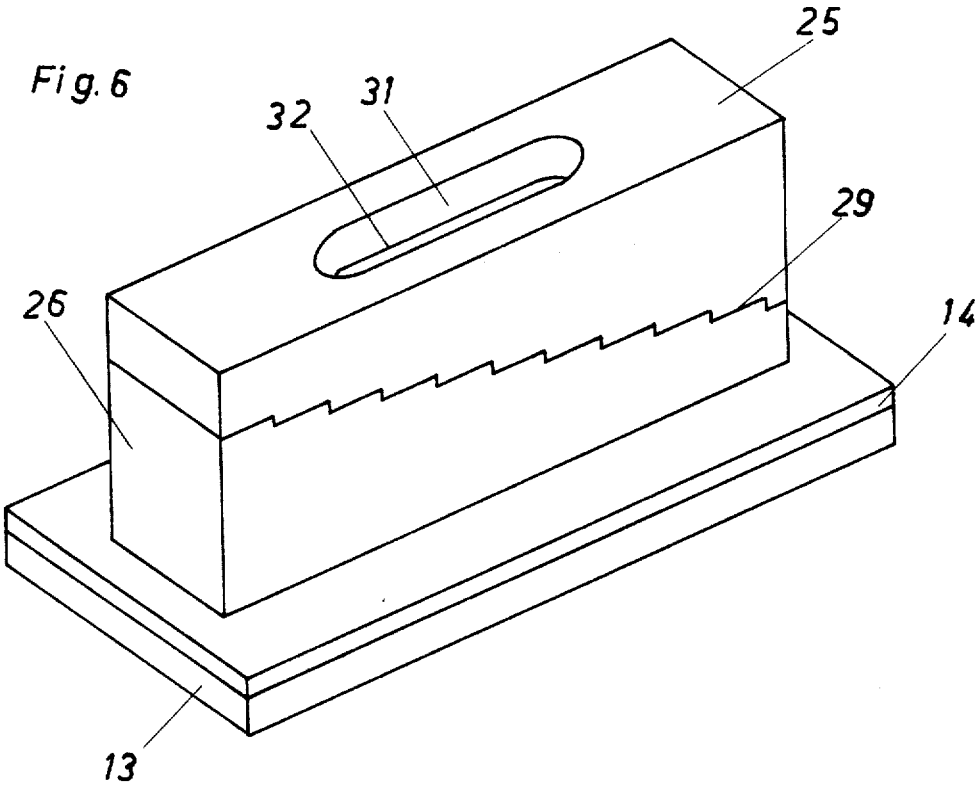
FIG. 6 is a perspective view showing a further possibility for adjusting the height between the outer plates and the profile element.

FIG. 6 illustrates a further possibility of adjusting the height or elevation between the outer plate 2 and the profile or shaped body 11 instead of using adjustment screws 12 as previously explained.

Figure 7:
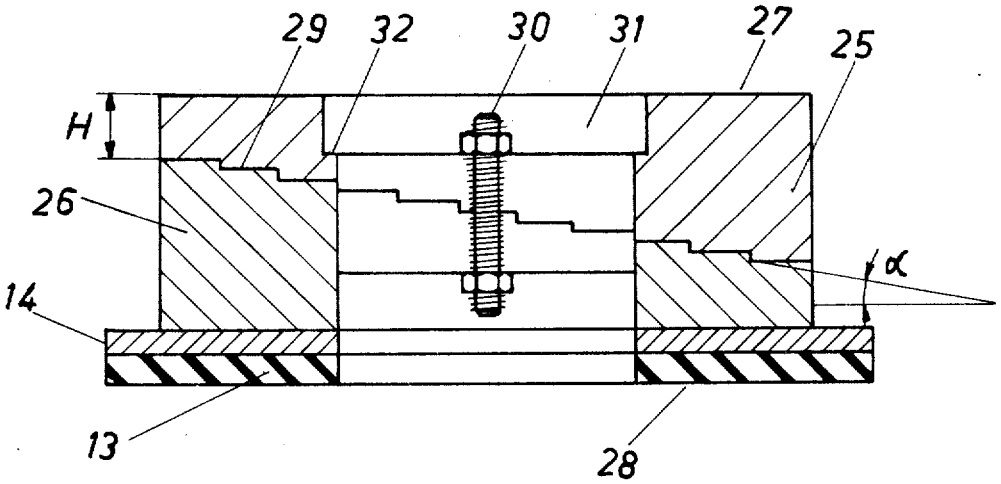
FIG. 7 is a cross-sectional view of the arrangement of FIG. 6.

FIG. 7 illustrates the elevational adjustment arrangement shown in perspective view in FIG. 6 in cross-sectional view. By displacing both of the wedges 25 and 26, which bear against one another and are located in superimposed fashion as shown, along their contact surface there is altered the height of both wedges which on the one hand bear with the surface 27 at the outer plate and, on the other hand, bear with the surface 28 at the profile body 11. Since the pressures are relatively great, particularly those caused by heavy vehicles, it is advantageous if the angle of inclination $\alpha$ of the contact surface with respect to the horizontal is as small as possible and the contact surfaces extend in a step-like or staircase manner, as generally indicated by reference character 29, so that the pressures acting upon the wedges in vertical direction act upon a surface which is located perpendicular thereto.

On the one hand, in order to prevent in the assembled condition a displacement of both wedges relative to one another and, on the other hand, in the non-assembled condition to be able to change the height or elevation, the wedges 25, 26 are held together by a threaded connection or threaded element 30. The slot-shaped bore 31 which passes through both wedges 25, 26 allows for a displacement of the wedges relative to one another notwithstanding the throughpassing threaded connection 30. The edge 32 in the bore 31 serves as a support surface for both of the threaded nut members of the threaded connection 30. Reference character H designates that length through which the height of the pair of wedges can be adjusted to a maximum.

In order to increase the support surface at the profile body there can be mounted a metallic plate or plate member 14 at the lower support surface 28. A molded piece or element 13 formed of rubber, plastic or the like and which is vulcanized or adhesively bonded to the metallic plate 14 dampens the vibrational oscillations of the outer plate 2. In order to prevent a displacement of both wedges in the assembled condition, it is advantageous to place the plates 13, 14 in a recess provided at the profile body 11.

Figure 8:
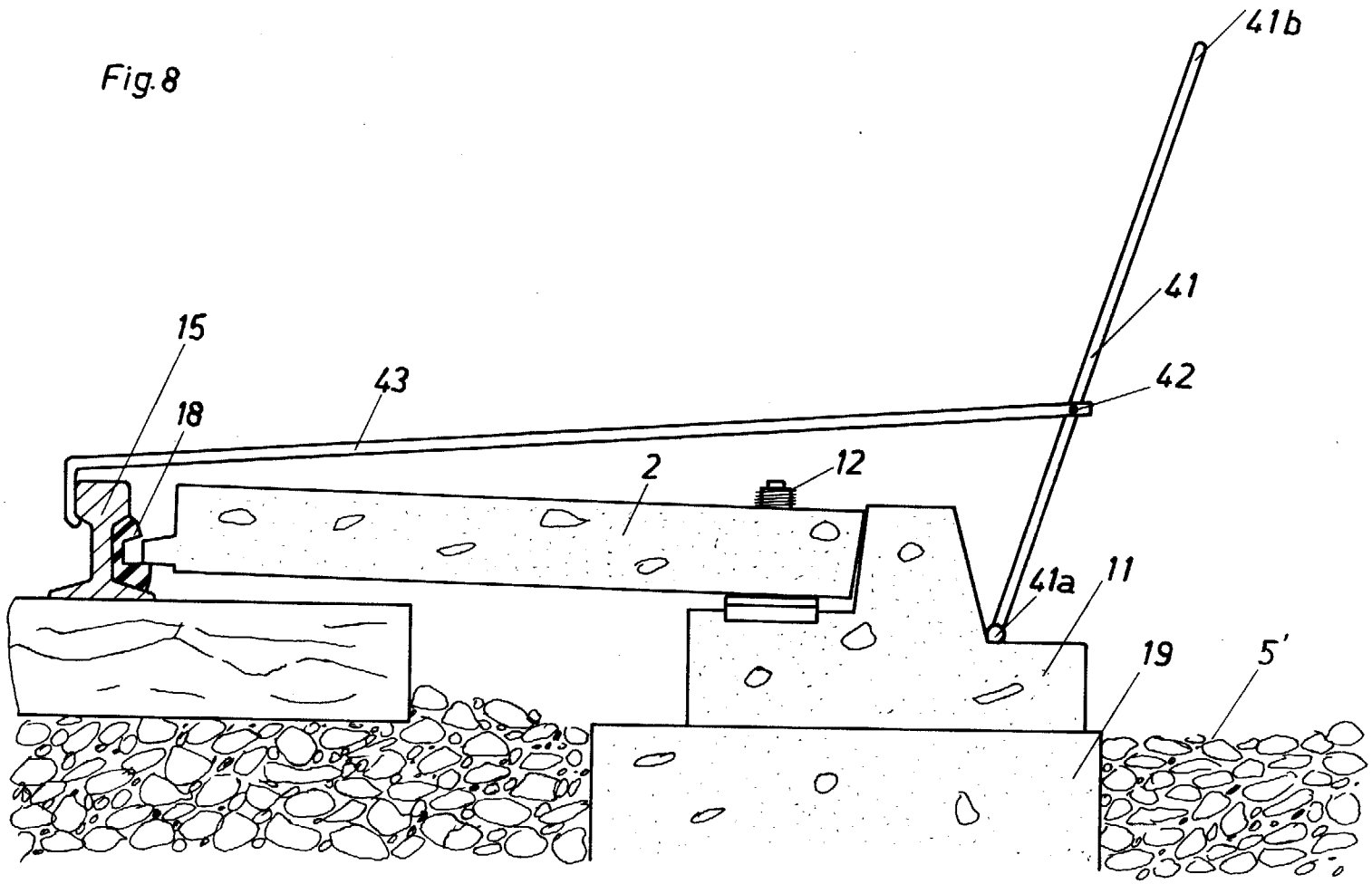
FIG. 8 illustrates a mounting arrangement according to the invention.

FIG. 8 illustrates the attachment of an arm 43 at the rail 15, and at such arm 43 there is attached at location 42 so as to be rotatably arranged a lever arm 41. This double-arm lever member or lever arm arrangement 41 renders possible, by applying a force to the upper arm 41*b*, the application of a considerably greater force by means of the second lever arm 41*a* bearing against the profile body 11 at such profile body 11 and the outer plate 2 which partially lies thereupon, with a result that the outer plate 2 is then pressed into the groove-like recess of the molded element or piece 18. In this way there is provided for a positive connection between the rail 15 and the outer plate 2.

During this insertion the profile or shaped body 11 slides at the upper surface of the concrete foundation 19. In order to fix the position of the profile or shaped body 11 such is embedded in gravel or the like. At the side of the roadway there is thus simultaneously formed the roadway body or road 1. Thereafter the outer plate 2 is adjusted to the level of the street or road, for instance by rotating the adjustment screw 12.

Figure 9:
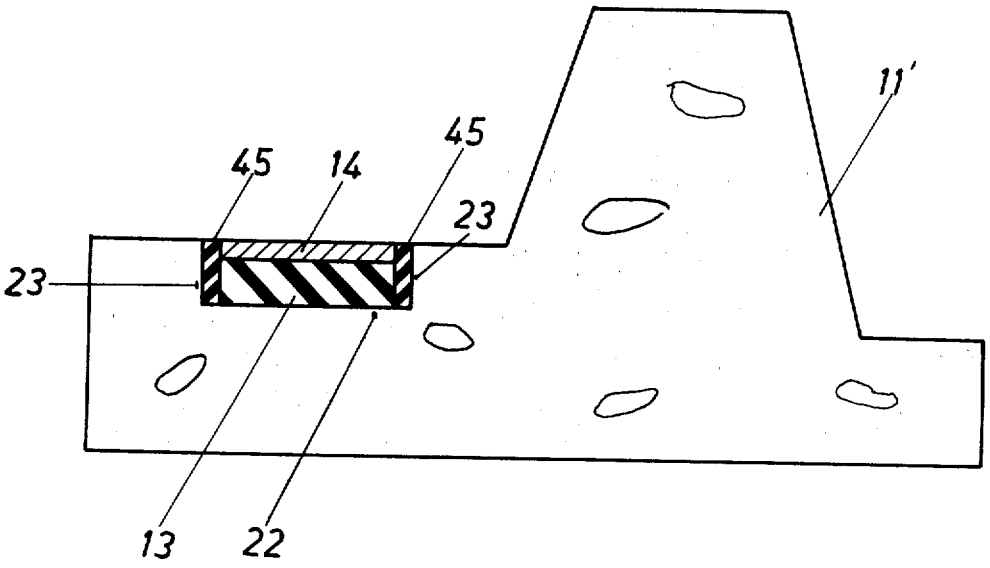
FIG. 9 is a sectional view through a profile element.

FIG. 9 illustrates the groove-like profiled or shaped portion 22 which is formed at the profile or shaped body 11 and serving for the reception of the metallic plate 14 and the molded body 13. The metallic plate 14 and molded body 13 which are inserted into the profile body 11 are laterally spaced from the walls 23 of groove 22 and are laterally surrounded by a band 45 formed of expanded or cellular rubber or the like, whereby there is rendered possible a vertical mobility of both molded body 13 and plate 14 for taking-up surge-like loads.

While there is shown and described present preferred embodiments of the invention, it is to be distinctly understood that the invention is not limited thereto, but may be otherwise variously embodied and practiced within the scope of the following claims. Accordingly,

What is claimed is:

1. A level crossing for a railroad having a pair of rails defining a track, comprising a roadway body located adjacent the rails, outer plates arranged between the rails and the roadway body, profiled closure means provided for the roadway body, the outer plates being supported at one side at the rails and at the other side at the profiled closure means, elastic molded body means for providing positive support of the outer plates at the profiled closure means of the roadway body, said profiled closure means being profiled in a groove-like manner at an essentially vertical surface thereof.

2. The level crossing as defined in claim 1, wherein the closure means of the roadway body is profiled in a resilient-like manner.

3. A level crossing for a railroad having a pair of rails defining a track, comprising a roadway body located adjacent the rails, outer plates arranged between the rails and the roadway body, profiled closure means provided for the roadway body, the outer plates being supported at one side at the rails and at the other side at the profiled closure means, elastic molded body means at the profiled closure means of the roadway body for providing positive support of the outer plates, said profiled closure means including at least one profile element, the outer plates being provided with adjustment screw means at the region of the profile element for changing the position of the outer plates, a groove having vertical walls formed in said profile element, at least one metallic plate arranged between the adjustment screw means and said elastic molded body means, said metallic plate and said elastic molded body means being located in said groove, and an elastic band arranged between the vertical walls of said groove and said elastic molded body means.

4. The level crossing as defined in claim 3, wherein the molded body means is connected with the metallic plate.

5. The level crossing as defined in claim 3, wherein the elastic band is formed of expanded rubber.

6. The level crossing as defined in claim 3, wherein the elastic band is formed of non-rigid polyurethane.

7. In a level crossing for a railroad having a pair of rails defining a track and including a roadway body located adjacent the rails, outer plates having first and second ends arranged respectively between the rails and the roadway body, and an elastic molded element for resiliently supporting the first ends of the outer plates at the side of one rail, the improvement comprising a profiled closure means located at the roadway body for supporting the second ends of the outer plates, and elastic molded body means interposed between said second ends of the outer plates and said profiled closure means, one of said profiled closure means and said second ends of the outer plates being provided with groove means, said elastic molded body means being at least partly disposed in said groove means, the other of said profiled closure means and said second ends of the outer plates being provided with shaped projections interfitting into said groove means.

8. A method of producing a level crossing for a railroad, comprising the steps of providing at least one profile element serving as a profiled closure for a roadway body, placing the profile element upon a concrete foundation formed at the region of the profiled closure of the roadway body, arranging an outer plate between a rail of the railroad and the profile element and with said outer plate partially bearing upon the profile element, pressing the outer plate together with the profile element towards a molded element mounted at the rail, thereafter fixing the position of the profile element by embedding the same in gravel, and then adjusting the outer plate to the level of the roadway body.

9. The method as defined in claim 8, including the step of forming the profile element of concrete.

10. The method as defined in claim 8, wherein the step of adjusting the outer plate to the level of the roadway body is carried out by rotating adjustment screw means.

* * * * *